United States Patent [19]

Ström

[11] 4,134,115

[45] Jan. 9, 1979

[54] DEVICE FOR SPREADING OF CHAFF PAYLOADS FOR RADAR INTERFERENCE

[75] Inventor: Johan P. Ström, Järfälla, Sweden

[73] Assignee: U.S. Philips Corporation, New York, N.Y.

[21] Appl. No.: 800,318

[22] Filed: May 25, 1977

[30] Foreign Application Priority Data

Jun. 1, 1976 [SE] Sweden ..... 7606167

[51] Int. Cl.[2] ..... G01S 7/38

[52] U.S. Cl. ..... 343/18 B; 221/88

[58] Field of Search ..... 343/18 B, 18 E; 221/88, 221/87; 222/390; 102/89 CD

[56] References Cited

U.S. PATENT DOCUMENTS

| | | | |
|---|---|---|---|
| 3,137,231 | 6/1964 | Johnson | 102/89 CD |
| 3,519,221 | 7/1970 | Kifor | 343/18 E |
| 3,765,336 | 10/1973 | Kulsik | 102/89 CD |
| 3,898,661 | 8/1975 | Kelly et al. | 343/18 E |

*Primary Examiner*—Maynard R. Wilbur
*Assistant Examiner*—Lawrence Goodwin
*Attorney, Agent, or Firm*—Algy Tamoshunas

[57] ABSTRACT

Disclosed is a device for spreading chaff payloads for radar interference comprising a cartridge having a number of oblong cells in which chaff bundles may be displaced towards the output end of the cartridge. The cells are arranged as units each having a displacement mechanism which is selectively operable. Each unit may be shaped as a self-supporting module preferably having three tube-shaped cells.

5 Claims, 5 Drawing Figures

DEVICE FOR SPREADING OF CHAFF PAYLOADS FOR RADAR INTERFERENCE

The invention is directed to a device for spreading chaff payloads for radar interference comprising a cartridge having a number of oblong tube-shaped cells in which bundles of chaff are displaceable towards the output end of the cartridge. The word chaff is used herein to refer generally to radar interferring means such as the usual type of foil ribbons, as well as similar means, for example, metal covered glass fibers and the like.

Devices of the type in question are known and used for spreading of chaff clouds from aeroplanes. Such a chaff cloud normally consists of a very great number of ribbons of different lengths which form dipoles of different lengths. Depending on the length of the dipoles, the chaff cloud will interfere at frequency bands used for radar reconnaissance, homing misiles and similar objects.

In the prior art devices, the chaff is ejected simultaneously from all the cells of the cartridge. Each cell is thus charged with chaff of different lengths adapted to interfere at the wave lengths of all the signals of interest. The resultant chaff cloud will consequently consist of ribbons of all lengths in question.

Modern aeroplanes used for spreading chaff may be provided with instruments for sensing and measuring the actual signal frequency bands, of which only one or two are normally of interest at the same time.

A first object of the invention is to provide a device of the type mentioned in the introduction which makes possible the use of the available frequency information regarding the frequency bands in question for generating a chaff cloud with improved interference characteristics.

This first object is fulfilled by a device which according to the invention is characterized in that the chaff storage cells are arranged as units comprising at least one cell. Each of the chaff storage units is provided with a mechanism for the displacement of the chaff bundles in the associated cell or cells, the mechanism being selectively operable with respect to further mechanisms. By charging each unit with chaff of the same length adapted to interfer at a corresponding frequency band it is possible to generate, with guidance from the available frequency information, a chaff cloud comprising dipoles of only the desirable length by activating the displacement mechanism of the appropriate unit or units. Obviously, selective ejection of this type results in important saving of chaff. For example, with selective dispersal of chaff, the weight of the ejected chaff producing a chaff cloud having the desired interference characteristic may be reduced by a factor of 5 as compared with prior art devices. The reduced weight of the chaff may in turn be used to reduce the weight of the overall ejection device.

Devices of this type are normally mounted beneath a wing of an aeroplane, from which it follows, among other things, the requirement for a compact structure of low air-resistance and low weight. A second object of the invention is to provide a device which fulfills this requirement. This is achieved in a preferred embodiment of the invention by making each chaff storage unit as a self-supporting module comprising a predetermined number of cells and building up the cartridge from an adequate number of such modules arranged alongside each other. Building the cartridge from modules of this type, obviates the need for separate support structures for the cells and consequently the cartridge may have the lowest possible weight and external dimensions.

One preferred embodiment of the device, according to the invention is comprised of modules of a uniform structure. Each of the modules or chaff storage units includes three cylindrical tubes which are arranged such that the central axes of the tubes form an equilateral triangle in at plane normal to their axes. Each module of this type is provided with a chaff displacement mechanism. The mechanism comprises, for example, a driving screw arranged axially with respect to the cells with an associated motor and a displacement member which is coupled to the driving screw for the displacement of the chaff bundles in the cells. By means of an appropriate number of such modules, the external dimensions and capacity of the cartridge, and therefore of the device, may be adapted to different uses.

The invention will be described in detail with reference to the drawings, in which:

FIG. 3 and FIG. 5 shows different embodiments of the displacement mechanism for the chaff bundles.

Figure 1:
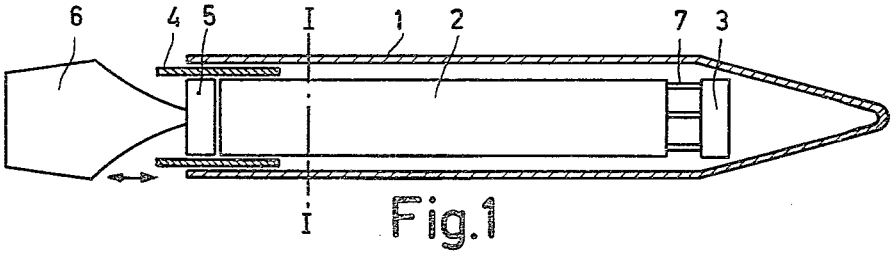
FIG. 1 shows a partly sectioned side view of a device according to the invention.

The device shown in FIG. 1 includes an aerodynamically shaped shell 1, which for the main part is occupied by an oblong cartridge 2, having a number of oblong cells (not shown) holding displaceable bundles of chaff. At one end the cartridge 2 supports a mechanism 3 for driving the driving screws 7 projecting from the cartridge which are associated with the different units of the cartridge. At the opposite or the ejection, end of the cartridge 2 there is a knife set 5 comprising a number of knives for cutting though the chaff bundles, which are normally wrapped in paper or a corresponding material, when the bundles pass by the knife-set. At the rear of the device is an end piece 6 of a shape such that adequate air flow conditions are obtained at the ejection end of the cartridge. A sleeve 4 of an external shape corresponding to the shell 1 is displacably arranged longitudinally of the device. When spreading chaff, the sleeve 4 is displaced into the shell 1 and, when the device is not in use, the sleeve 4 is moved to a position in which the outer end thereof is in contact with the end piece 6.

Figure 2:
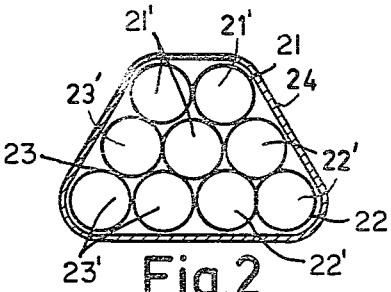
FIG. 2 shows a cross section view through the cartridge provided in the device of FIG. 1.

FIG. 2 shows a sectional view along the line I—I of FIG. 1. As shown in the figure, the cartridge includes three modules 21,22,23, which are surrounded by an external shell 24 corresponding to the shell 1 of FIG. 1. Each module includes three cylindrical cells 21', 22' and 23', respectively, of a length corresponding to the length of the cartridge of FIG. 1 and of an internal diameter which is adapted to the dimension of the chaff bundles. From the figure it is evident that the cells of the respective modules are arranged in a triangle, i.e. in a manner such that the central axes of the cells form the corners of an equilateral triangle. The modules may be connected by means of longitudinal weld joints positioned at appropriate places where the modules are in contact.

Figure 3:
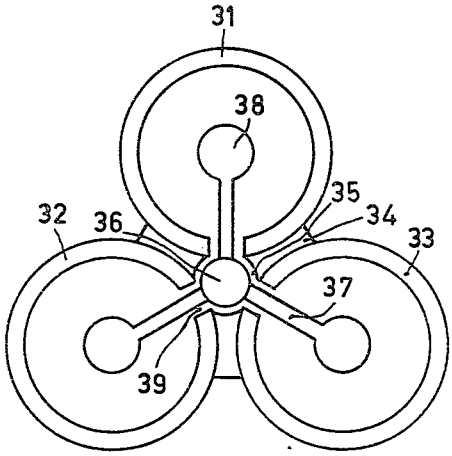
FIG. 3 shows in greater detail the structure of one of the modules of the cartridge shown in FIG. 2.

FIG. 3 shows in greater detail the structure of the modules of FIG. 2. The module is formed by three cylindrical tubes 31,32,33 of a wall thickness sufficient to makes the module self-supporting. The module may be moulded in one piece, or, alternatively built from three identical tubes which have been connected by means of longitudinal weld joints 34. The space between the tubes forms a longitudinal channel 35 and whose longitudinal axis is coincident with the central axis of the module. Each tube is provided with a longitudinal opening 39 between the tube and channel 35. A bundle displacement member 36 is arranged for movement longitudinally of the channel 35. Member 36 comprises a central part 36 the shape of which is adapted to the shape of the channel and which supports three wings 37. Each wing projects into an associated tube through its longitudinal opening 39. The ends 38 of the wings 37 which are positioned in the tubes and have a shape suitable for displacement of the chaff bundles.

Figure 4:
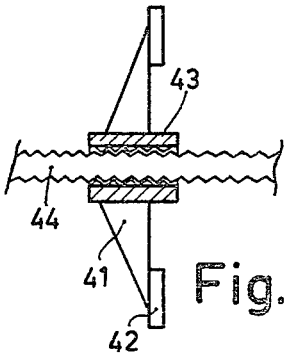
FIG. 4 shows a partial sectional view of the displacement member and driving screw.

FIG. 4 shows in greater detail a partly sectioned side view of the bundle displacement member of FIG. 3 and the associated driving screw. As shown in the figure, the central part 43, of the displacement member is provided with an internal thread engaging the driving screw 44. The figure also shows the wings 41, with their the outer ends 42 which are intended to be in contact with the chaff bundles stored in the cells of the module. The displacement member is mounted for movement to the right as viewed in the drawing when the screw 44 is turned.

Figure 5:
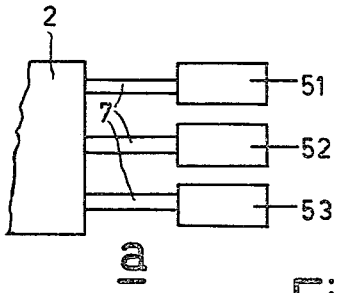
Figure 5:
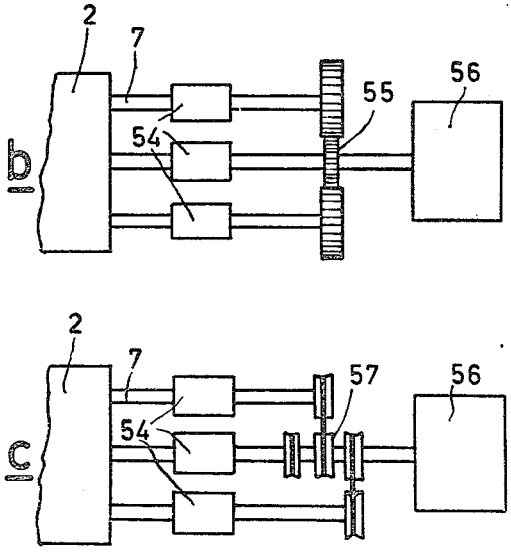

FIG. 5 shows different embodiments of the mechanism for selectively displacing the chaff bundles stored in the modules. In the embodiment of FIG. 5a, the driving screws 7 projecting from the front of the cartridge 2 are each connected to the shaft of an associated driving motor 51, 52 and 53, respectively. The motors may be activated independently of each other in order to achieve the desired operation mode.

In the embodiment of FIG. 5*b*, the driving screws projecting from the cartridge 2 are each connected by an associated electrically operable coupling means 54 and a gear transmission 55 to a common driving motor 56. The gear transmission 55 is then preferably so shaped that all the input shafts of the couplings 54 are rotated when the shaft of the motor 56 is rotated. The couplings 54 are operable independently of each other. Activation of a desired one or more of the couplings 54, produces the intended selective operation mode.

FIG. 5 shows a modified embodiment of the mechanism of FIG. 5*b*. The difference with respect to the embodiment of FIG. 5*b* is that the gear transmission 55 has been replaced by a belt transmission 57. Suitably shaped so called toothed belts may, for example, be used for this purpose.

The cartridge shown in FIG. 2 is composed of three modules of the type shown in FIG. 3. By means of this triangular module according to the invention cartridges having a cross section of substantially every desirable shape may evidently be built. By using a suitable number of modules it is, for example, possible to obtain a cross section having the shape of a hexagon. One characteristic of the triangular, self-supporting module of the invention is, that it allows the construction of cartridges of an extremely high packing density of the chaff bundles contained therein. The selected shape of the module having three cells furthermore makes possible a construction which is mechanically good and rigid for the bundle displacement member (41, 42, 43, see FIG. 4), and in which the risk of an uneven load as a consequence of differences between the frictional forces of the different tubes and of the resultant interference with the operation of the device is essentially negligible.

What is claimed is:

1. A device for spreading radar interferring chaff comprising a cartridge having an output end for dispensing the chaff, at least one modular chaff storage unit disposed in said cartridge and including three cylindrical tubes for storing said chaff arranged in said cartridge such that the central axes of said tubes are generally parallel to each other and form an equilateral triangle in a plane normal to said central axes, the sides of said tubes adjacent the longitudinal axis of said storage unit defining an axially extending channel, said tubes each having a longitudinally extending opening formed in the side thereof adjacent said channel, and means for displacing chaff stored in each storage unit including a hollow central member having on internal thread arranged in said channel for movement therealong, said central member having three wings each extending therefrom into a different one of said three tubes through said opening, said wings each terminating in an end portion adapted to displace the chaff stored in the associated tube upon movement of said central member, and a rotatable drive screw arranged in said channel which extends through said central member and engages said internal thread for moving said central member toward said one end of said cartridge.

2. A device according to claim 1, including a plurality of said storage units and wherein said drive means includes a separate selectively operable motor for rotating the drive screw associated with each storage unit.

3. A device according to claim 1, including a plurality of said storage units and wherein said drive means includes a common motor for rotating said drive screws of the respective storage units and means for selectively coupling said drive screws to said motor.

4. A device for spreading radar interferring chaff comprising a cartridge having an output end for dispensing the chaff, a plurality of oblong tubular cells disposed within said cartridge, said cells being arranged in groups each including at least one cell, the cells of each group defining a storage unit for storing chaff of a size different from that stored in at least one other storage unit and means for selectively displacing chaff stored in each of said storage units toward said output end to thereby selectively dispense chaff of a size adapted to interfere at a corresponding radar frequency band, said chaff displacing means including a member arranged in each cell for movement generally parallel to the central axis of the cell for displacing the chaff stored therein and a drive screw coupled to the members arranged in the cells of each storage unit for moving said members toward said output end.

5. A device according to claim 4, wherein each of said storage units includes three of said cells connected to each other and arranged such that the central axes of said cells form an equilateral triangle in a plane normal to said axes, said cells each having a wall of a thickness sufficient to render said cells self-supporting.

* * * * *